US011591745B2

(12) United States Patent
Park

(10) Patent No.: US 11,591,745 B2
(45) Date of Patent: Feb. 28, 2023

(54) SYSTEMS AND METHODS FOR RESTORING SHRUNKEN GARMENTS

(71) Applicant: Seung Jin Park, Hwaseong-si (KR)

(72) Inventor: Seung Jin Park, Hwaseong-si (KR)

( * ) Notice: Subject to any disclaimer, the term of this patent is extended or adjusted under 35 U.S.C. 154(b) by 226 days.

(21) Appl. No.: 17/071,998

(22) Filed: Oct. 15, 2020

(65) Prior Publication Data

US 2021/0332523 A1 Oct. 28, 2021

(51) Int. Cl.
*D06F 59/02* (2006.01)
*D06F 58/20* (2006.01)

(52) U.S. Cl.
CPC ..... *D06F 59/02* (2013.01); *D06F 58/203* (2013.01)

(58) Field of Classification Search
CPC ..... D06F 59/02; D06F 58/203; A47G 25/00; A47G 25/14; A47G 25/1485; F26B 25/14; F26B 3/04; F26B 21/00; F26B 21/01; F26B 21/002; F26B 21/006; A41H 5/00; A41H 5/02; A41D 27/22
See application file for complete search history.

(56) References Cited

U.S. PATENT DOCUMENTS 1,191,970 A * 7/1916 Hlubucek ..... D06F 73/00 223/70
1,659,097 A * 2/1928 Gygi ..... D06F 73/00 D32/6
1,737,434 A * 11/1929 Sahagian ..... D06F 73/00 223/67
2,189,789 A * 2/1940 Frentzel ..... D06F 59/02 223/70
2,551,209 A * 5/1951 Glover, Sr. ..... D06F 73/00 223/67
3,184,127 A * 5/1965 Smith ..... D06F 59/02 223/67
3,262,615 A * 7/1966 Killey ..... D06F 73/00 223/67
3,531,027 A * 9/1970 Malmin ..... A47G 25/4007 223/88
3,892,047 A * 7/1975 Muller-Scherak ..... D06F 59/02 34/103
4,613,066 A * 9/1986 Saucy ..... A47G 25/20 34/103
5,555,648 A * 9/1996 Griffin ..... D06F 73/00 223/67

FOREIGN PATENT DOCUMENTS

| | | | |
|---|---|---|---|
| JP | 07-100300 | A | 4/1995 |
| JP | 23505945 | A | 3/2011 |
| KR | 20090050622 | A | 5/2009 |
| KR | 1020160140206 | A | 7/2016 |

* cited by examiner

*Primary Examiner* — Ismael Izaguirre

(57) ABSTRACT

Disclosed herein are drying system and method for restoring clothes shrunk after washing and drying of the clothes. The clothes drying system includes: an air injection part for injecting air into the drying system; a drying tube of which the volume is expandable by the air injected through the air injection part; a jig put on the outer surface of the drying tube; and a fixing part attached to the clothes and fixing the clothes and jig so that the clothes put on the outer surface of the jig is not shrunk while being dried.

4 Claims, 5 Drawing Sheets

SYSTEMS AND METHODS FOR RESTORING SHRUNKEN GARMENTS

CROSS-REFERENCE TO PRIOR APPLICATIONS

This application claims the benefit of Korean Patent Application No. 10-2020-0051070, filed on Apr. 27, 2020, which is all hereby incorporated by reference in its entirety.

BACKGROUND OF THE INVENTION

Field of the Invention

The present invention relates to drying system and method for restoring clothes shrunk after washing and drying of the clothes, and more particularly, to a drying system for restoring clothes shrunk after washing and drying of the clothes, which includes: an air injection part for injecting air into the drying system; a drying tube of which the volume is expandable by the air injected through the air injection part; a jig for stopping the expansion after the drying tube is expanded to prescribed shape and size; and a fixing part for fixing clothes worn on the drying tube not to be shrunk while being dried, and a drying method for restoring clothes shrunk after washing and of the clothes.

Background Art

In order to smooth out crumpled parts after washing shirts, trousers, or others (hereinafter, called 'clothes'), people iron the clothes. However, because such ironing is not carried out well according to materials of clothes or at sewed parts, unskilled people have a difficulty in ironing.

Therefore, most of unskilled people put the clothes at the laundry. In this case, there are inconvenience that the people have to drop off at the laundry and pick up the clothes from the laundry or receive delivery. Moreover, there is an economic burden, and especially, the people feel a great burden when putting clothes that must be frequently washed and changed in the summer season.

Therefore, in order to smooth out crumpled parts of clothes after washing the clothes or before wearing the clothes, an air bag manufactured in the form of clothes has been disclosed. The air bag is made with a plastic sheet expanded by air (mainly, hot air is used) injected through an air injector. The crumpled clothes are covered on the air bag, and the air bag is expanded by air so as to smooth out the crumped clothes.

However, in the above way, the injected air is hot air, and the air bag in the form of a shirt has a head part, arm parts formed at the left and the right, a body part disposed at the lower part, and a close rim formed at the lower end of the body part to inject air and prevent air leak. The close rim is inserted into the air injector, and then, air is injected into the air bag. Such an air bag is made of a plastic sheet in consideration of airtightness and economic feasibility. However, such a plastic sheet is shrunk by hot air when hot air is injected, namely, the air bag having the form of the clothes is shrunk due to repeated use for a certain period of time, and so the air bag cannot be used. Especially, the air bag cannot be used during a drying process immediately after washing and spinning-dry.

SUMMARY OF THE INVENTION

Accordingly, the present invention has been made to solve the above-mentioned problems occurring in the prior arts, and it is an object of the present invention to provide a drying system for restoring clothes shrunk after washing and drying of the clothes, which includes: an air injection part for injecting air into the drying system; a drying tube of which the volume is expandable by the air injected through the air injection part; a jig for stopping the expansion after the drying tube is expanded to prescribed shape and size; and a fixing part for fixing clothes worn on the drying tube not to be shrunk while being dried, and a drying method for restoring clothes shrunk after washing and of the clothes.

To accomplish the above object, according to the present invention, there is provided a drying system for restoring clothes shrunk after washing and drying of the clothes including: an air injection part for injecting air into the drying system; a drying tube of which the volume is expandable by the air injected through the air injection part; a jig put on the outer surface of the drying tube; and a fixing part attached to the clothes and fixing the clothes and jig so that the clothes put on the outer surface of the jig is not shrunk while being dried.

The drying tube is made of a synthetic resin material and is expanded up to the size of the jig by air injected through an air injector, and the jig has a mesh fabric for restraining the expansion so that the clothes to be dried do not stretch over the size of the jig.

In this instance, the mesh fabric is made of a nonelastic material which is not expanded, and an inner space of the mesh fabric is smaller than the drying tube which is expanded to the maximum. Therefore, the drying tube expanded in the state where the jig is covered is fit to the inner space of the mesh fabric.

The fixing part fixes the jig at the corresponding position of the drying tube so that the drying tube goes into the correct position in the mesh fabric when the drying tube is expanded. Preferably, fixing positions of the fixing part are indicated on the drying tube and the jig.

In the meantime, the fixing part includes a wrist fixing part fixed to the wrist part of the clothes to be dried, and a waist fixing part fixed to the waist part of the clothes.

In another aspect of the present invention, there is provided a drying method for restoring clothes shrunk after washing and drying of the clothes including the steps of: putting and preparing a fabric softener in lukewarm water; dipping clothes in the lukewarm water during a predetermined period of time; washing the clothes dip in the lukewarm water; removing moisture of the washed clothes; preparing a drying tube of which the volume is expanded by air injected by an air injector; covering a jig on the prepared drying tube; covering the moisture-removed clothes on the jig; attaching a waist fixing part to the clothes and fixing the waist fixing part to fix the clothes and the jig at the waist part so that the clothes are not shrunk at the waist part while being dried; attaching a wrist fixing part and fixing the wrist fixing part to fix the clothes and the jig to the wrist part so that the clothes are not shrunk at the wrist part while being dried; removing the waist fixing part and the wrist fixing part after drying of the clothes is finished; removing the air injected into the drying tube; and removing the drying tube and the jig from the clothes.

According to the present invention, provided are a drying system for restoring clothes shrunk after washing and drying of the clothes, which includes: an air injection part for injecting air into the drying system; a drying tube of which the volume is expandable by the air injected through the air injection part; a jig for stopping the expansion after the drying tube is expanded to prescribed shape and size; and a fixing part for fixing clothes worn on the drying tube not to be shrunk while being dried, and a drying method for restoring clothes shrunk after washing and of the clothes.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
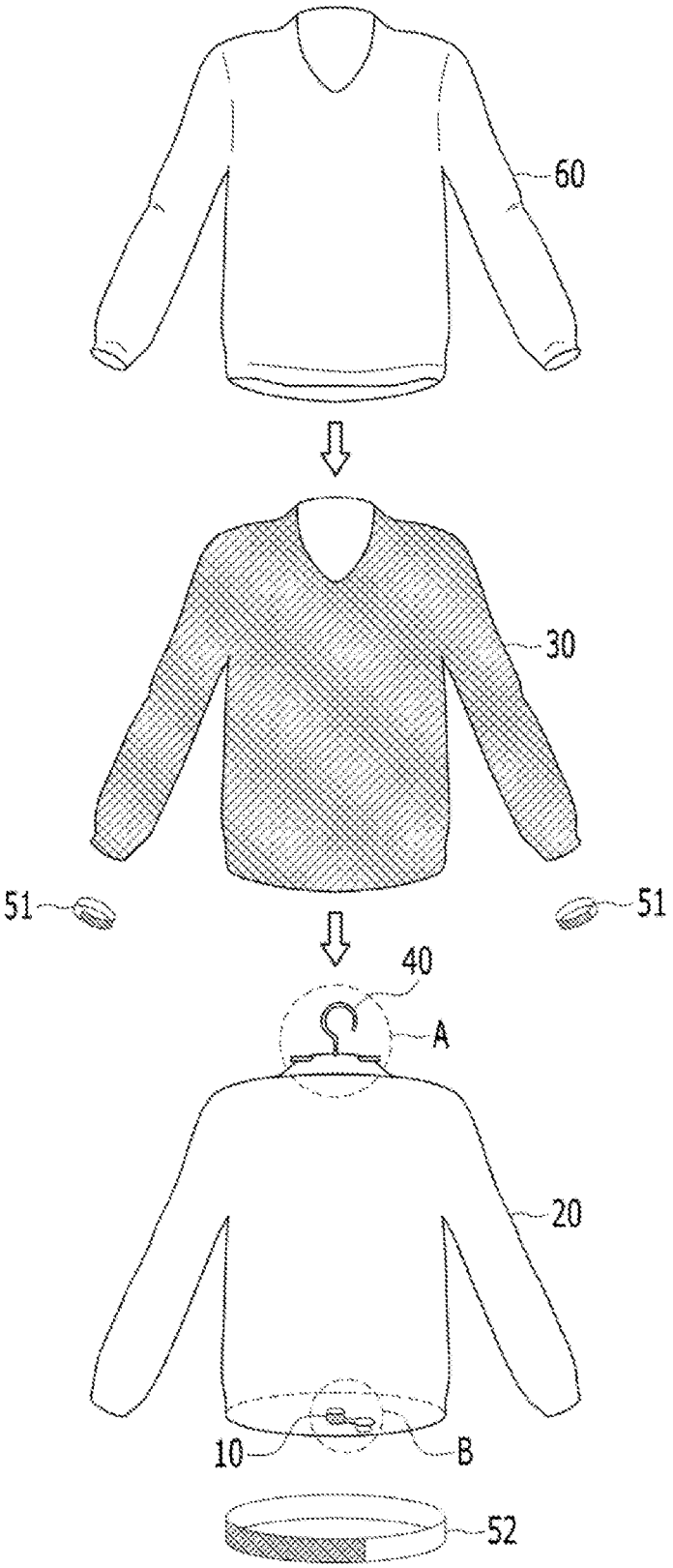
FIG. 1 is a view showing a system for drying clothes according to an embodiment of the present invention.

Hereinafter, the embodiments of the present disclosure will be described in detail with reference to accompanying drawings so that the embodiments may be easily implemented by those skilled in the art. However, the present disclosure may be implemented in various ways without being limited to the embodiments.

It is noted that the figures are schematic and not drawn to scale. The relative dimensions and ratios of the parts in the figures have been exaggerated or reduced in size for clarity and convenience in the figures and any dimensions are merely exemplary and not limiting. And the same reference numerals are used to refer to similar features in the same structure, element or part shown in more than one figure.

Embodiments of the present invention specifically illustrate ideal embodiments of the present invention. As a result, various modifications of the drawings are expected. Thus, the embodiment is not limited to the specific form of the illustrated region, but includes, for example, modification of the form by manufacture.

A system for drying clothes according to the present invention includes an air injection part for injecting air into the drying system, and a drying tube of which the volume is expandable by the air injected through the air injection part. The air injection part has a body and a lid which are formed integrally. Preferably, the lid is not separated even after being opened in order to inject air. Preferably, the drying tube is made of a synthetic resin material with elasticity so as to be expanded by the air injected through the air injection part.

The clothes drying system according to the present invention further includes: a jig for stopping the expansion of the drying tube after the drying tube is expanded to prescribed shape and size; a hanging part formed at an end of the drying tube so that clothes covering the drying tube, the drying tube and the jig can be hung on the hanging part; and a fixing part for fixing the clothes worn on the drying tube not to be shrunk while being dried.

The jig is formed to cover the outer surface of the drying tube and the clothes to be dried cover the outer surface of the jig so that the clothes can be dried. Preferably, the jig has a mesh fabric for stopping the expansion at a specific size so that the clothes to be dried do not stretch over the size of the jig.

Figure 2:
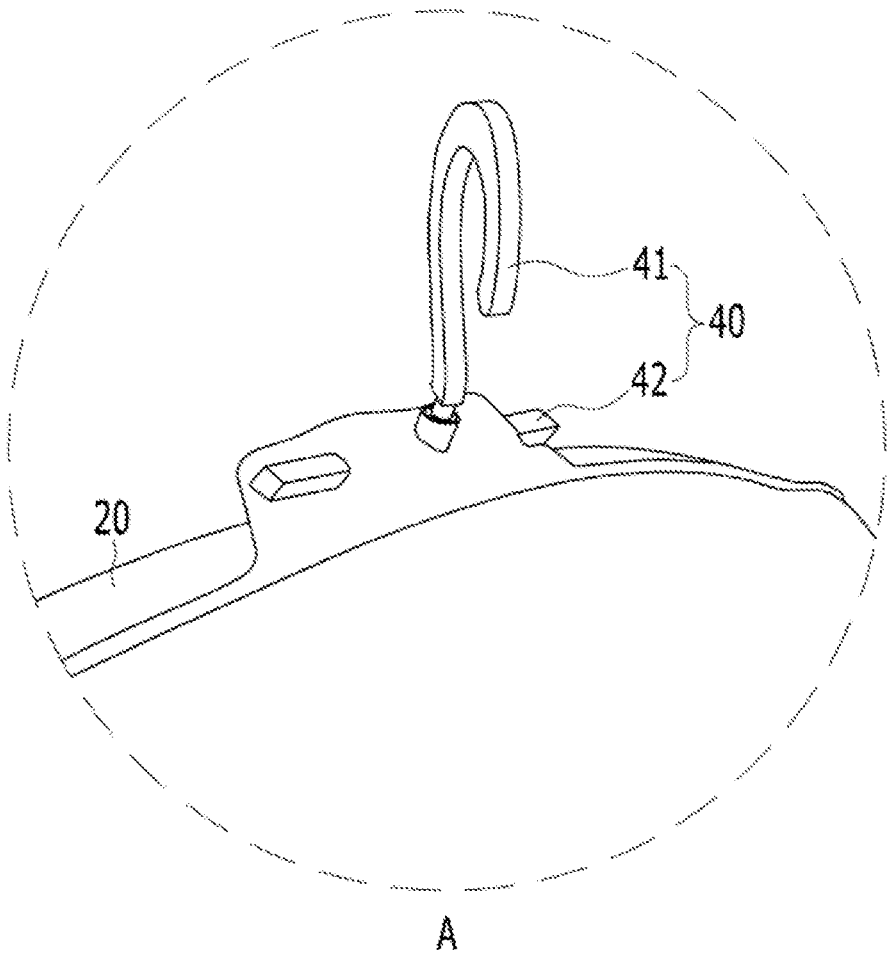
FIG. 2 is an enlarged view of an "A" part of FIG. 1 according to an embodiment of the present invention.

As shown in FIG. 2, the hanging part includes a hook part formed in a hook shape at an end of the drying tube to be combined with the drying tube, and a support part connected with the hook part and formed to pass a hole formed at one end of the drying tube.

Figure 3:
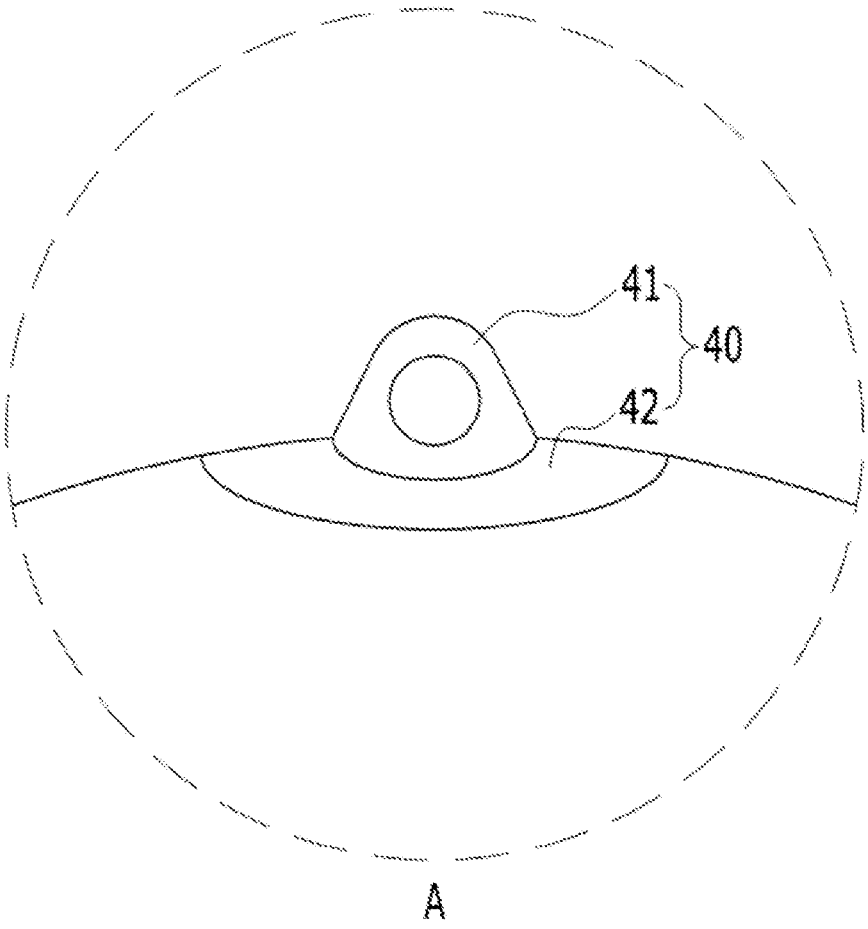
FIG. 3 is an enlarged view of an "A" part of FIG. 1 according to another embodiment of the present invention.
Figure 4:
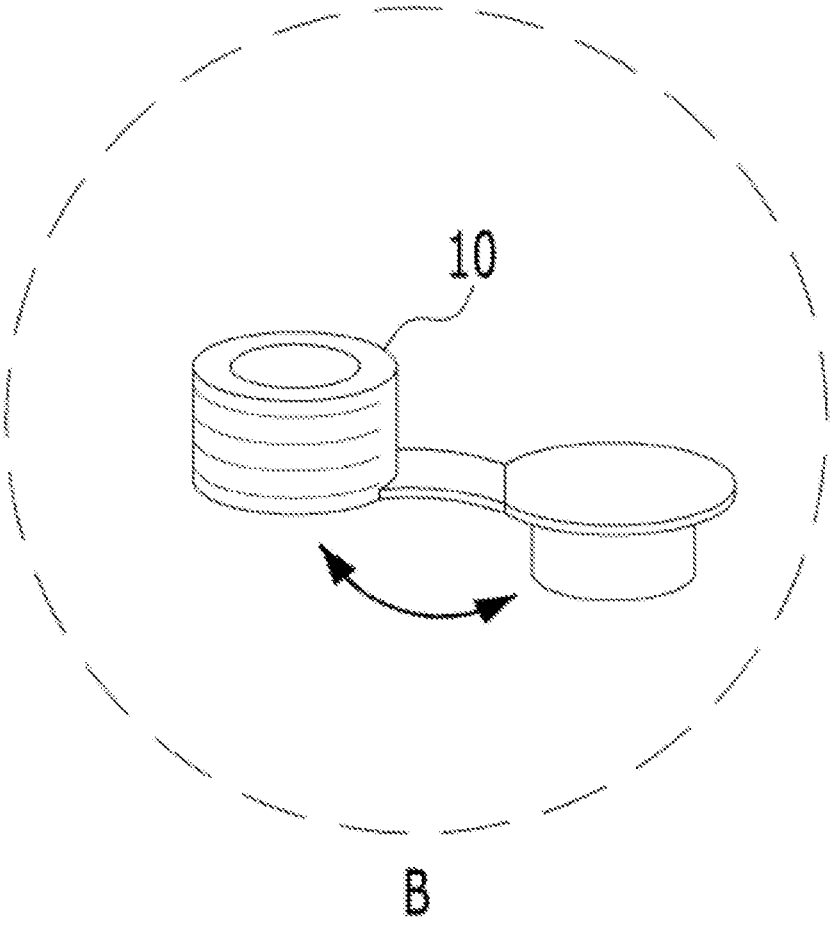
FIG. 4 is an enlarged view of a "B" part of FIG. 1.

Moreover, as shown in FIG. 3, the hook part of the hanging part has the hole for hanging the clothes thereon. FIG. 4 is an enlarged view of a "B" part of FIG. 1.

As depicted, the fixing part includes a wrist fixing part fixed at the wrist part of the clothes to be dried, and a waist fixing part fixed at the waist part of the clothes to be dried. Each of the wrist fixing part and the waist fixing part includes a Velcro combining part for fixing using a Velcro tape and at least one means selected from a rubber band with elasticity or a belt coupling part which is coupled by the tightening level set by a user.

In this instance, preferably, the fixing part fixes the jig at a corresponding position of the drying tube so that the drying tube is put at a correct position inside the mesh fabric when the drying tube is expanded. Preferably, fixing positions of the fixing part are indicated on the drying tube and the jig. After the coupling position between the drying tube and the jig is correctly adjusted, the fixing part fixes them, so that the drying tube goes into the correct corresponding position inside the jig.

Figure 5:
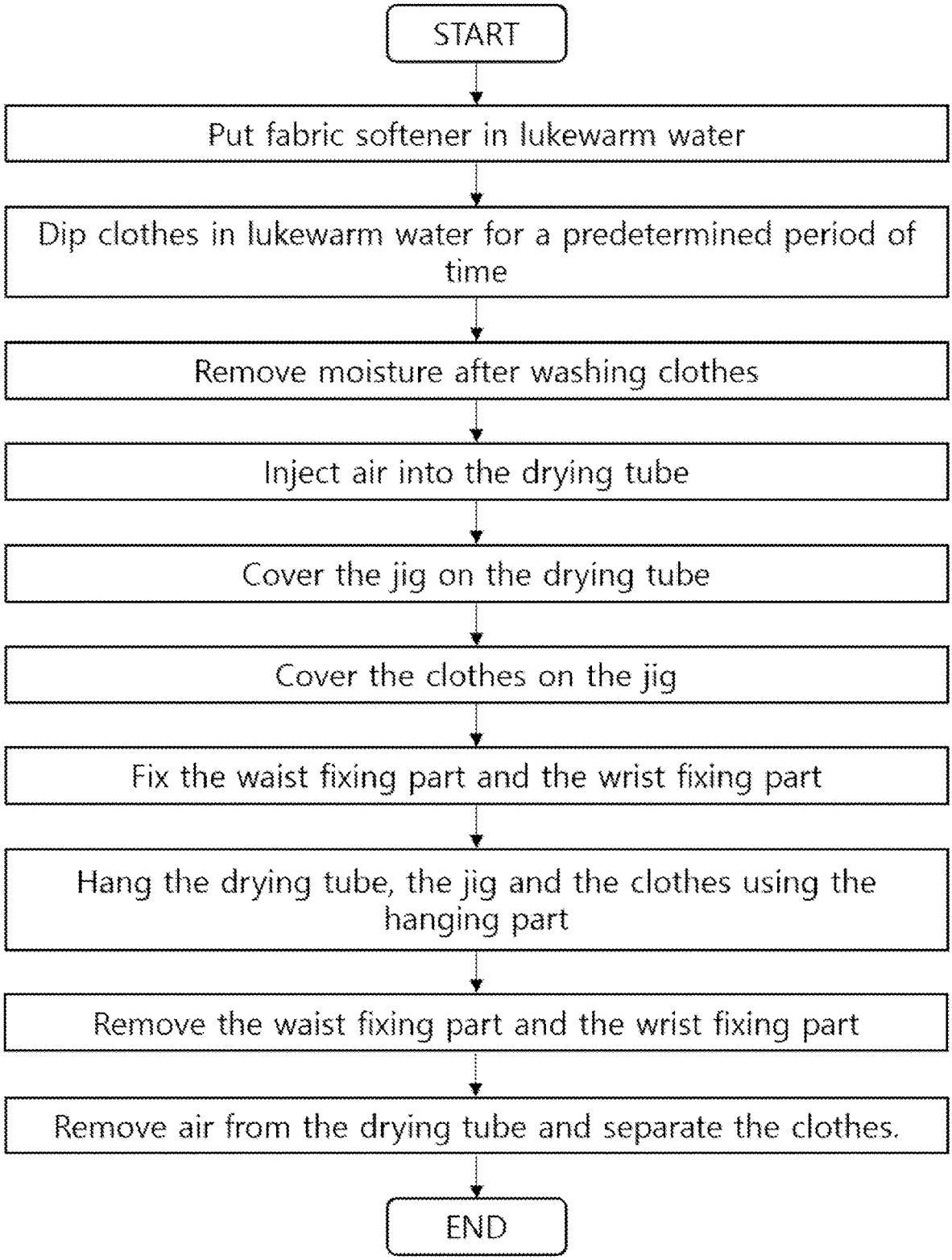
FIG. 5 is a view showing a process of a method for drying clothes according to an embodiment of the present invention.

FIG. 5 is a view showing a process of a method for drying clothes according to an embodiment of the present invention. Hereinafter, a method for operating the clothes drying system according to the present invention will be described.

The present invention is to prevent clothes, especially knitwear, from being shrunk during a drying process after washing. In order to achieve the above, first, a jig having the size similar with the clothes to be dried is prepared. For convenience in drying clothes, the tube for injecting air has one size, and jigs of various kinds which can be changed according to sizes of clothes are prepared.

That is, the jig with the size similar with the clothes to be dried is prepared, and the jig is worn on the drying tube. In the above process, air is injected into the drying tube, the jig is put on the drying tube, and then, the clothes to be dried is put on the jig.

After that, when the user continuously injects air till the drying tube is expanded to fit the size of the jig, the jig is expanded no more after being expanded to fit the size of the jig. However, it is also possible that the jig is first put on the drying tube, the clothes to be dried is put on the jig, and then, air is injected till the drying tube is expanded as much as the size of the jig.

For this, preferably, the drying tube is made of an elastic material to be expanded a lot without limitation in size. In order to use the jig having the size similar to that of the clothes to be dried, the jig must be made of an inelastic material so as not to be expanded anymore even though air is injected after being expanded to the fixed size. In detail, preferably, the jig is made with mesh fabric without elasticity which can dry the clothes.

As described above, the clothes drying method according to the present invention includes the steps of: putting and preparing a fabric softener in lukewarm water; dipping clothes in the lukewarm water during a predetermined period of time; and washing the clothes dip in the lukewarm water.

After washing, the clothes drying method according to the present invention further includes the steps of: removing moisture of the washed clothes; preparing the drying tube of which the volume is expanded by air injected by the air injector; covering the jig on the prepared drying tube such that the jig is not expanded anymore after being expanded to predetermined shape and size; and covering the moisture-removed clothes on the drying tube and the jig.

Furthermore, the waist fixing part is fixed at the drying tube, the jig and the waist part of the clothes so that the clothes are not shrunk at the waist part while being dried. The wrist fixing part is fixed at the drying tube, the jig and the wrist part of the clothes so that the clothes are not shrunk at the wrist part while being dried.

After fixing, the drying tube, the jig and the clothes are hung on the hanging part formed at one end of the drying tube. After drying of the clothes, the waist fixing part and the wrist fixing part are removed, and the air injected into the drying tube is removed. The drying tube and the jig are removed from the clothes so that the clothes to be dried are separated from the drying system.

Preferably, a weight ratio of a softening agent:dimethicone:behentrimonium chloride:purified water in the fabric softener is 2:2:1:5, where the softening agent is one of garment softening agents sold under the trademarks SOFTEX A211®, SOFTEX K-304 LIQ®, SOFTEX K-711®, SOFTEX K-730®, SOFTEX S-40®, SOFTEX S-150®, SOFTEX SG-320® by Kao Corporation located in New Taipei City, Taiwan. Preferably, the softening agent is SOFTEX K-730® that prevents static electricity and provides softness and conditioning effect. Dimethicone is mainly dimethicone (CH3)3SiO[(CH3)2SiO]nSi(CH3)3 on the straight chain, and average degree of polymerization n is 3 to 650. Behentrimonium chloride is used as a softener, a preserved agent, a preservative and is used to prevent static electricity.

The drying tube is made of a synthetic resin material with elasticity so as to be expanded by the air injected through the air injection part. The jig is formed to cover the outer surface of the drying tube and the clothes to be dried cover the outer surface of the jig so that the clothes can be dried. Preferably, the jig has a mesh fabric for stopping the expansion at a specific size so that the clothes to be dried do not stretch over the size of the jig. The hanging part includes a hook part formed in a hook shape at an end of the drying tube to be combined with the drying tube, and a support part connected with the hook part and formed to pass a hole formed at one end of the drying tube. Each of the wrist fixing part and the waist fixing part includes a Velcro combining part for fixing using a Velcro tape and at least one means selected from a rubber band with elasticity or a belt coupling part which is coupled by the tightening level set by the user. Detailed description is the same as the above.

As described above, while the present invention has been particularly shown and described with reference to the example embodiments thereof, it will be understood by those of ordinary skill in the art that the present invention can be implemented as other concrete forms without changing the inventive concept or essential features.

EXPLANATION OF REFERENCE NUMERALS

10: air injection part
20: drying tube
30: jig
40: hanging part
41: hook part
42: support part
50: fixing part
51: wrist fixing part
52: waist fixing part
80: clothes

What is claimed is:

1. A drying system for restoring clothes shrunk after washing and drying of the clothes comprising:

an air injection part for injecting air into the drying system;

a drying tube of which the volume is expandable by the air injected through the air injection part, wherein the drying tube is made of a synthetic resin material with elasticity so as to be expanded by the air injected through the air injection part;

a jig formed to cover an outer surface of the drying tub, wherein the jig has a mesh fabric for stopping the expansion at a specific size so that the clothes to be dried do not stretch over the size of the jig, wherein the jig is put on the outer surface of the drying tube, wherein the clothes to be dried cover the outer surface of the jig to be dried; and a fixing part, including a wrist fixing part fixed at a wrist part and a waist fixing part fixed at a waist part of the clothes to be dried, attached to the clothes and fixing the clothes and jig so that the clothes put on the outer surface of the jig is not shrunk while being dried.

2. The drying system according to claim 1, wherein each of the wrist fixing part and the waist fixing part includes hook-and-loop fastener combining part for fixing using hook-and-loop fastener tape and at least one means selected from a rubber band with elasticity or a belt coupling part which is coupled by the tightening level set by a user.

3. A method for drying clothes comprising the steps of:

putting and preparing a fabric softener in lukewarm water;

dipping clothes in the lukewarm water during a predetermined period of time;

washing the clothes dip in the lukewarm water;

removing moisture of the washed clothes;

preparing a drying tube of which the volume is expanded by air injected by an air injector;

covering a jig on the prepared drying tube;

covering the moisture-removed clothes on the jig;

fixing a waist fixing part at the drying tube, the jig and the waist part of the clothes so that the clothes are not shrunk at the waist part while being dried;

fixing a wrist fixing part at the drying tube, the jig and the wrist part of the clothes so that the clothes are not shrunk at the wrist part while being dried;

removing the waist fixing part and the wrist fixing part after drying of the clothes is finished;

removing the air injected into the drying tube; and removing the drying tube and the jig from the clothes.

4. The method for drying clothes according to claim 3, wherein a weight ratio of a softening agent:dimethicone:behentrimonium chloride:purified water in the fabric softener is 2:2:1:5, wherein the drying tube is made of a synthetic resin material with elasticity so as to be expanded by the air injected through the air injection part, wherein the jig has a mesh fabric for stopping the expansion at a specific size so that the clothes to be dried do not stretch over the size of the jig, wherein each of the wrist fixing part and the waist fixing part includes a Velcro hook-and-loop fastener combining part for fixing using hook-and-loop fastener tape and at least one means selected from a rubber band with elasticity or a belt coupling part which is coupled by the tightening level set by the user, and wherein the softening agent is a garment softening agent.

* * * * *